US006439940B1

(12) United States Patent
Pouchkarev

(10) Patent No.: US 6,439,940 B1
(45) Date of Patent: Aug. 27, 2002

(54) FIN AND WATERCRAFT SYSTEM

(76) Inventor: Alexander Pouchkarev, 416 W. 40th St., San Pedro, CA (US) 94731

( * ) Notice: Subject to any disclaimer, the term of this patent is extended or adjusted under 35 U.S.C. 154(b) by 0 days.

(21) Appl. No.: 09/841,721

(22) Filed: Apr. 24, 2001

(51) Int. Cl.[7] ..... B63B 1/00
(52) U.S. Cl. ..... 441/79; 441/74; 114/152
(58) Field of Search ..... 441/74, 79; 114/152

(56) References Cited

U.S. PATENT DOCUMENTS

| | | | | | |
|---|---|---|---|---|---|
| 4,733,496 | A | * | 3/1988 | Wallner | 441/79 |
| 4,854,904 | A | * | 8/1989 | Wahl | 441/79 |
| 5,070,804 | A | * | 12/1991 | Strazzeri | 114/152 |
| 5,152,705 | A | * | 10/1992 | Rock | 441/74 |
| 5,567,190 | A | * | 10/1996 | Oates | 441/79 |
| 5,997,376 | A | * | 12/1999 | Block et al. | 441/79 |
| 6,053,789 | A | * | 4/2000 | Miyashiro | 441/79 |
| 6,059,621 | A | * | 5/2000 | Vogel | 441/74 |
| 6,213,044 | B1 | * | 4/2001 | Rodgers et al. | 441/79 |

* cited by examiner

*Primary Examiner*—S. Joseph Morano
*Assistant Examiner*—Lars A Olson

(74) *Attorney, Agent, or Firm*—David A. Belasco

(57) ABSTRACT

A fin and watercraft system includes at least one pair of fins mounted to the underside of a watercraft adjacent the side edges. The fins rotate freely from a position substantially parallel to the centerline of the watercraft through an arc of up to 90 degrees to alternate positions angled from the nearest side edge toward the centerline of the watercraft. The fins include a front portion extending from a leading edge to a vertical axis and a rear portion extending from the vertical axis to a trailing edge. The rear portion is larger than the front portion causing the fin to rotate in the direction of an oncoming water flow. The fins have symmetrical lateral surfaces and include a bearing plate mounted in a recess in the lower surface of the watercraft. A pin extends from a top surface of the fin engages an arcurate slot in the bearing plate to limit rotation of the fin. In a variant of the invention, a setscrew fitted to a threaded opening in the side edge of the watercraft is positioned to bear against the pin, varying the initial angle of the fin to the centerline of the watercraft. An opening fitted with a sealing plug penetrates the upper surface of the watercraft and permits a water stream to be introduced into the recess so that dirt and debris may be flushed from the bearing plates and out through a flexible seal at the lower surface of the watercraft surrounding the fin.

18 Claims, 13 Drawing Sheets

Fig. 6 a
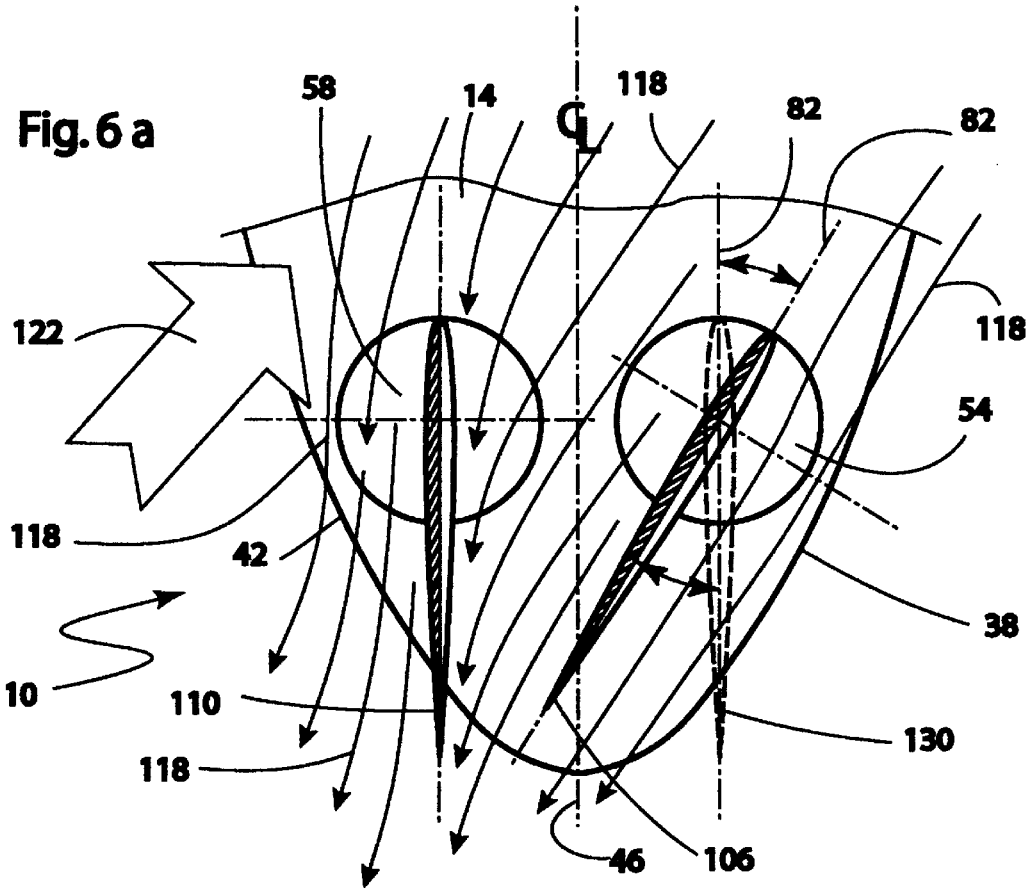
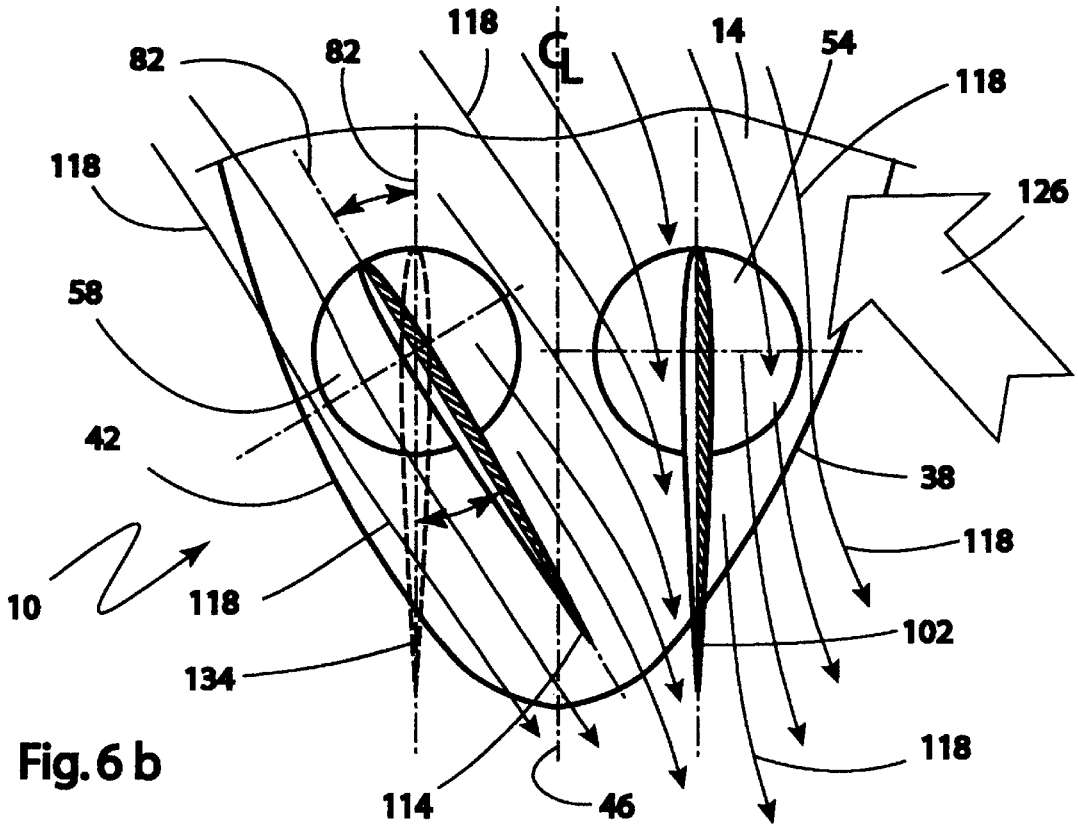
Fig. 6 b

FIN AND WATERCRAFT SYSTEM

FIELD OF INVENTION

The invention pertains to stabilizing fins for use with watercraft. More particularly, the invention relates to movable fins for use with surfboards, windsurfers, kite surfers and boats.

BACKGROUND OF THE INVENTION

Various designs for fins, both fixed and movable have been developed for use with surfboards and other watercraft. Movable fins provide allow for enhanced directional guidance associated with multiple fin systems while permitting reduced water resistance during turns. U.S. Pat. No. 6,053,789 issued to Miyashiro discloses a limited pivotal fin system for a surfboard. The system includes an upper stationary mounting portion attached to the underside of the surfboard, and a lower pivoting fin with a limited rotational pivoting mechanism located in an upper recessed area on the leading edge of the pivoting fin.

U.S. Pat. No. 4,811,674 issued to Stewart, describes a foil arrangement for water-borne craft in which the hull of the watercraft includes a pair of tiltable foils disposed at the stern of the craft at either side of the centerline. The foils tilt outwardly when the watercraft is moving straight ahead, causing the rear of the craft to lift, thus reducing hydrodynamic drag and increasing speed. The foils tilt downwardly and inwardly in turns, acting as an extra fin and serving to tighten the turn of the watercraft.

U.S. Pat. No. 4,854,904, issued to Wahl discloses a sailboard with an adjustable keel mechanism. The keel is capable of pivoting about a vertical axis located rearwardly from the center of the keel. The keel is forced by the flow of oncoming water to rotate in the windward direction from its centered position. A spring-loaded detent may be employed to return the keel to its centered position.

U.S. Pat. No. 4,733,496 issued to Wallner illustrates a pivoting surfboard fin that includes a rudder-like section that swings out when a turn is commenced, enhancing the maneuverability of the surfboard by redirecting the water flow through the pivoting rudder section in the direction of the turn. The fin employs a spring-loaded pin traveling in a tapered channel, which channel is deepest at the centerline of the fin, to center the rudder-like section of the fin.

U.S. Pat. No. 3,890,661 issued to Johnson discloses a surfboard rudder-fin combination that permits the surfer to vary the angle of the fin with respect to the surfboard by shifting his weight on the board. A spring-loaded lever arm is employed to control the degree of rotation of the fin. While other variations exist, the above-described designs for movable watercraft fins, rudders and foils are typical of those encountered in the prior art.

It is an objective of the present invention to provide a fin system for watercraft that will permit tighter turning and improve maneuverability of the craft by providing at least one fin that will resist maneuvering forces while permitting an opposing fins to "feather" or turn so as not to oppose the oncoming flow, thus minimizing drag from inactive fin. It is a further objective to provide a system that avoids unnecessary drag when the watercraft moves in a downwind direction by permitting fins on either side of the watercraft to automatically assume an orientation that minimizes resistance to the water flow beneath the craft. It is yet a further objective to permit the user of the system to adjust the limits of the arc through which the fin may rotate. It is still a further objective to enhance the ability of wind-powered watercraft to move in an upwind direction. Finally, it is an objective of the invention to provide the above-described capabilities in an inexpensive and durable fin system that may be easily cleaned of sand and debris and that may be easily repaired and maintained.

While some of the features of the present invention are disclosed in the prior art, none of the inventions found satisfy all of the requirements identified.

SUMMARY OF THE INVENTION

The present invention addresses all of the deficiencies of prior art fin and watercraft inventions and satisfies all of the objectives described above.

A fin and watercraft system providing the desired features may be constructed from the following components. A watercraft is provided. The watercraft has a front end, a rear end, a midpoint between the front end and the rear end, a lower surface, an upper surface, first and second sides and a centerline between the first and second sides. At least one pair of fins is provided. The pair of fins includes a first side fin and a second side fin. The pair of fins is located between the midpoint and the rear end of the watercraft, equidistant from the centerline and equidistant from the rear end.

The first side fin is located adjacent the first side of the watercraft and the second side fin is located adjacent the second side. Each of the first and second side fins has a top end, a bottom end, a leading edge, a trailing edge and a vertical axis. A horizontal axis extends from the leading edge to the trailing edge of the fin. A front portion of the fin extends from the leading edge to the vertical axis. A rear portion of the fin extends from the vertical axis to the trailing edge. The fin includes and first and second lateral surfaces. Each of the first and second side fins is rotatably mounted about the vertical axis to the lower surface of the watercraft. The first side fin is rotatable from a first position to a second position. The second side fin is rotatable from a third position to a fourth position.

When the watercraft is forced to move in a direction parallel to its centerline, an oncoming flow of water beneath the watercraft will cause the first side fin and the second side fin to rotate to the first and third positions, respectively. When the watercraft is forced to move in a direction from the centerline toward its first side, the oncoming water flow will cause the first side fin to rotate to the second position and the second side fin to remain in the third position. When the watercraft is forced to move in a direction from the centerline toward its second side the oncoming water flow will cause the second side fin to rotate to the fourth position and the first side fin to remain in the first position.

In a variant of the invention, when the first side fin is located in the first position its horizontal axis is parallel to the centerline of the watercraft. When the second side fin is located in the third position its horizontal axis is parallel to the centerline of the watercraft. When the first side fin is located in the second position its horizontal axis is angled toward the centerline at between zero and ninety degrees to a position of the horizontal axis when the first side fin is located in the first position. When the second side fin is located in the fourth position its horizontal axis is angled toward the centerline at between zero and ninety degrees to a position of the horizontal axis when the second side fin is located in the third position.

In a further variant, when the first side fin is located in the first position its horizontal axis is angled toward the centerline of the watercraft at a fixed angle between zero and fifteen degrees. When the second side fin is located in the third position its horizontal axis is angled toward the centerline of the watercraft at a fixed angle between zero and fifteen degrees. When the first side fin is located in the second position its horizontal axis is angled toward the centerline at between zero and ninety degrees to a position of the horizontal axis when the first side fin is located in the first position. When the second side fin is located in the fourth position its horizontal axis is angled toward the centerline at between zero and ninety degrees to a position of the horizontal axis when the second side fin is located in the third position.

In yet another variant of the invention, the rear portion of each of the first and second side fins is larger than the front portion of the fins, causing the fins to rotate so as to align with a flow of oncoming water.

In still another variant, the first lateral surface of each of the first and second side fins is symmetrical to the second lateral surface of each of the first and second side fins.

In still a further variant, a circular rotational portion is located at the top end of each of the fins. The rotational portion has a top surface and a bottom surface. The top surface is at right angles to the vertical axis and has a first circular bearing track adjacent a perimeter of the top surface. The first circular bearing track has a first diameter and a first width. An axle is provided. The axle has a first end and a second end and is fixedly attached to the fin at the second end and extends upwardly through the vertical axis. The axle has an attaching means located at the first end. A securing means is provided. The securing means is sized and shaped to engage the attaching means at the first end of the axle.

A circular bearing plate is provided. The bearing plate has a central orifice and is sized to slidably accommodate the axle. The bearing plate has an upper surface and a lower surface. The lower surface has a second circular bearing track of the first diameter and of the first width adjacent to a perimeter of the bearing plate. The second bearing track is sized and shaped to fit slidably against the first bearing track.

A bearing is provided. The bearing has an outer shell and an inner sleeve. The sleeve is slidably rotatable within the outer shell, the outer shell is fixedly mounted to the upper surface of the bearing plate above the central orifice. The inner sleeve is attached to the axle such that the axle cannot rotate with respect to the sleeve. Means are provided for limiting rotation of the fin with respect to the bearing plate.

A recess is provided. The recess extends upwardly from the lower surface of the watercraft and is sized and shaped to accommodate the first end of the axle, the attaching means, the circular bearing plate, the bearing and the top surface of the circular rotational portion of the fin. Means are provided for attaching the bearing plate within the recess such that the bearing plate does not rotate with respect to the watercraft and the top surface of the circular rotational portion of the fin is maintained at a level of the lower surface of the watercraft.

When the first end of the axle is extended through the orifice in the bearing plate and secured to the inner sleeve of the bearing, the first bearing track is fitted slidably against the second bearing track, the securing means engaging the attaching means at the first end of the axle and the bearing plate is secured to the recess, the fin will be rotatably attached to the lower surface of the watercraft.

In another variant of the invention, the first and second lateral surfaces join the bottom surface of the circular rotational portion of each of the first and second side fins in a radius, thereby increasing the resistance of each of the fins to lateral forces.

In still another variant, a first ball bearing race is provided. The first ball bearing race extends upwardly from the first circular bearing track and is sized and shaped to fit slidably a series of ball bearings of a second diameter. A mating second ball bearing race is provided. The second ball bearing race extends downwardly from the second circular bearing track and is sized and shaped to fit slidably a series of ball bearings of the second diameter. A series of ball bearings of the second diameter is provided. The series of ball bearings is located between the first and second circular bearing races.

In still a further variant the bearing is either a ball bearing or a roller bearing.

In yet a further variant of the invention, the attaching means is a male thread located at the first end of the axle and the securing means is a washer and a mating threaded locking nut.

In another variant, the attaching means is a transverse hole in the first end of the axle and the securing means is a washer and pin. The pin is sized and shaped to fit frictionally within the transverse hole.

In yet another variant, the watercraft includes an opening. The opening extends from the upper surface of the watercraft into the recess. The opening provides access to the attaching means and the securing means. The opening provides for means for introducing a stream of water into the recess to facilitate the removal of dirt and debris from the bearing and from the first and second circular bearing tracks.

In still another variant, the fin and watercraft system includes a removable sealing plug. The plug is sized and shaped to fit frictionally within the opening.

In a further variant, the system includes a flexible seal. The flexible seal includes a ring. The ring is formed of resilient material and is fixedly attached to the recess of the watercraft. The ring extends from the lower surface of the watercraft upwardly for a first predetermined distance. The ring is sized and shaped to fit slidably about an outer diameter of the circular rotational portion of the fin. When the ring bears against the outer diameter of the circular rotational portion of the fin, a flexible seal will be formed that permits rotation of the fin with respect to the watercraft while controlling the entry of sand and debris into a region of the bearing plate.

In still a further variant of the invention, the means for limiting rotation of the fin with respect to the bearing plate includes a pin. The pin extends vertically from the top surface of the circular rotational portion of the fin for a first predetermined distance. The pin is spaced from the vertical axis of the fin by a second predetermined distance. An arcurate slot is provided. The slot has a first end and a second end and penetrates the bearing plate from its upper surface to its lower surface. The arcurate slot is sized and shaped to slidably fit the pin. The first end of the slot is positioned such that the fin is in either the first position or the third position when the pin is positioned at the first end of the slot. The second end of the slot is positioned such that the fin is in either the second position or the fourth position when the pin is positioned at the second end of the slot.

In still another variant, the fin and watercraft system includes a threaded opening. The opening extends from the first or second side of the watercraft to the nearest recess adjacent the pin. An elongated setscrew is provided. The setscrew is sized and shaped to engage the threaded opening and is of sufficient length to bear against the pin when the fin is in either of the first or third position. When the setscrew is turned inwardly to bear against the pin, the horizontal axis of the fin will be deflected from being parallel to the centerline of the watercraft by an angle of between zero and fifteen degrees.

In still a further variant, the lower surface of the watercraft has a symmetrical V-shaped cross-section.

In a final variant of the invention, the included angle of the V-shaped cross-section is between one hundred fifty degrees and one hundred eighty degrees.

An appreciation of the other aims and objectives of the present invention and an understanding of it may be achieved by referring to the accompanying drawings and the detailed description of a preferred embodiment.

DESCRIPTION OF THE DRAWINGS

FIG. 6*a* is a bottom side plan view detail illustrating the watercraft being forced to move in a direction from the centerline towards its first side;

FIG. 6*b* is a bottom side plan view detail illustrating the watercraft being forced to move in a direction from the centerline towards its second side;

DETAILED DESCRIPTION OF THE PREFERRED EMBODIMENT

Figure 1:
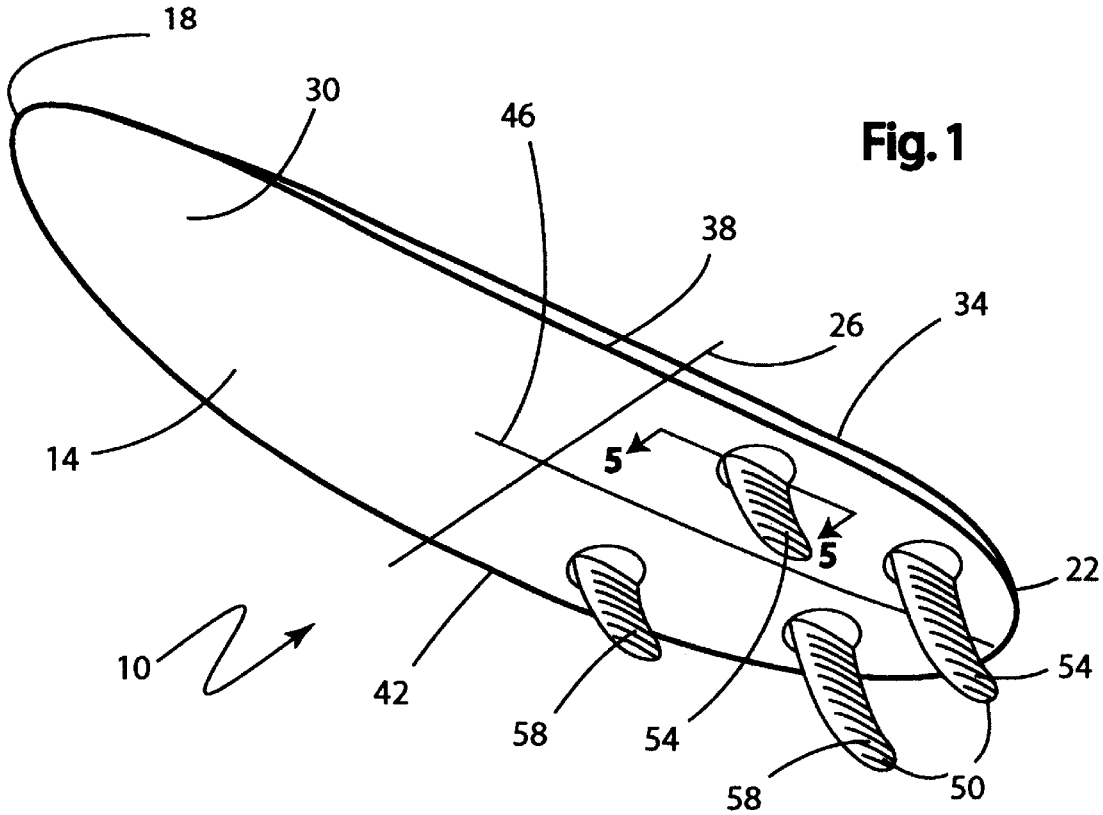
FIG. 1 is a perspective view of the preferred embodiment of the invention illustrating the attachment of fins to the lower surface of a watercraft.
Figure 2:
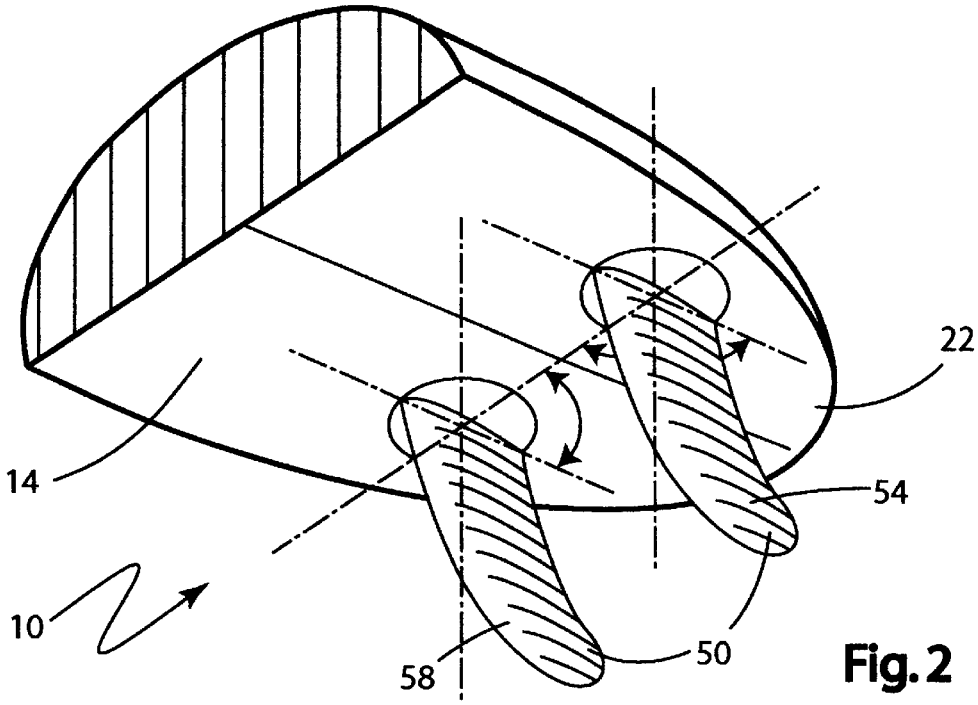
FIG. 2 is an enlarged perspective detail of a rear portion of the FIG. 1 embodiment illustrating the rotational capability of the fins.

FIGS. 1 and 2 illustrate a fin and watercraft system 10 providing the desired features that may be constructed from the following components. A watercraft 14 is provided. The watercraft 14 has a front end 18, a rear end 22, a midpoint 26 between the front end 18 and the rear end 22, a lower surface 30, an upper surface 34, first 38 and second 42 sides and a centerline 46 between the first 38 and second 42 sides. At least one pair of fins 50 is provided. The pair of fins 50 includes a first side fin 54 and a second side fin 58. The pair of fins 50 is located between the midpoint 26 and the rear end 22 of the watercraft 14, equidistant from the centerline 46 and equidistant from the rear end 22.

Figure 3:
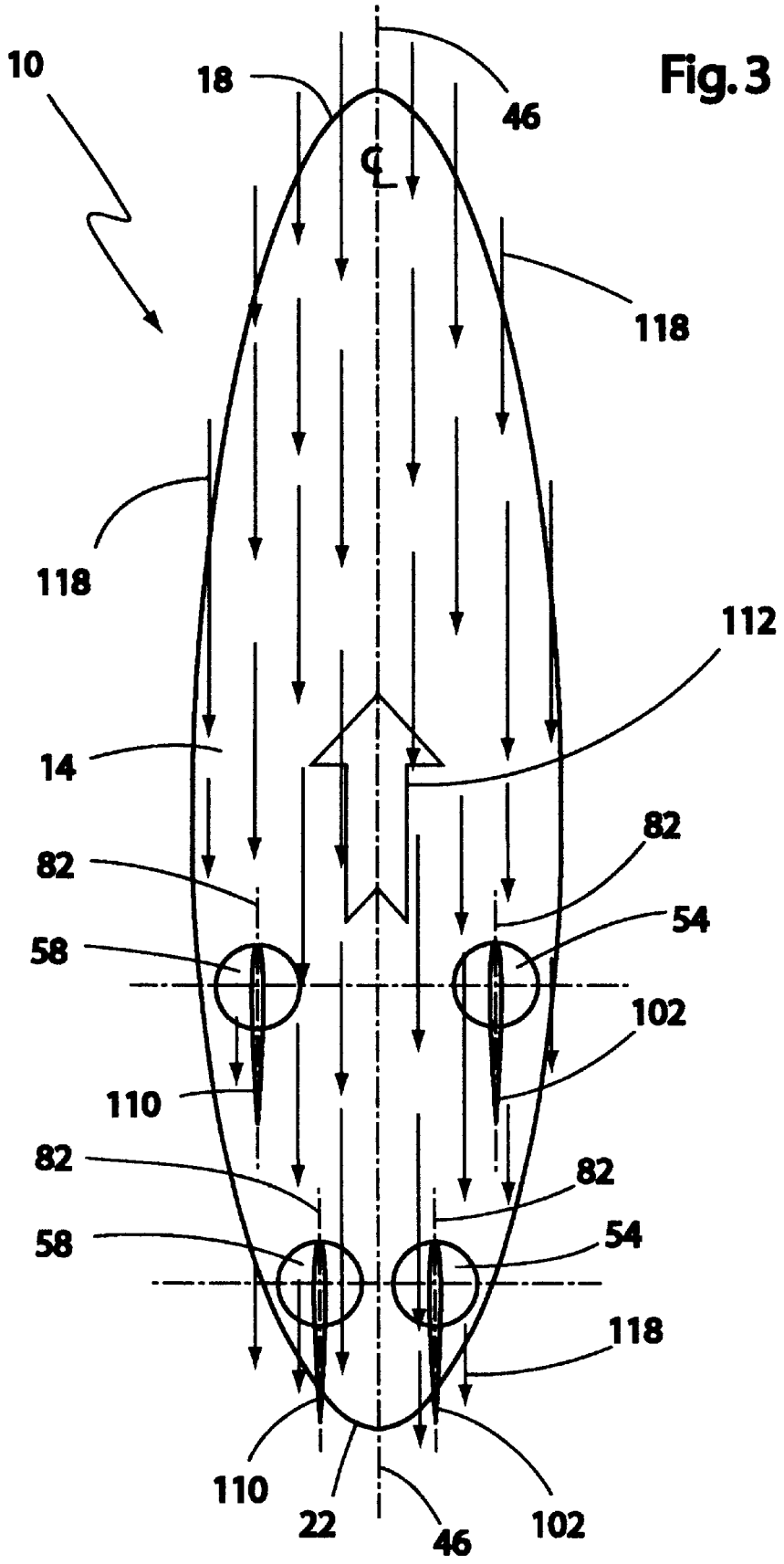
FIG. 3 is a bottom side plan view of the FIG. 1 embodiment illustrating the rotational capability of the fins.
Figure 7:
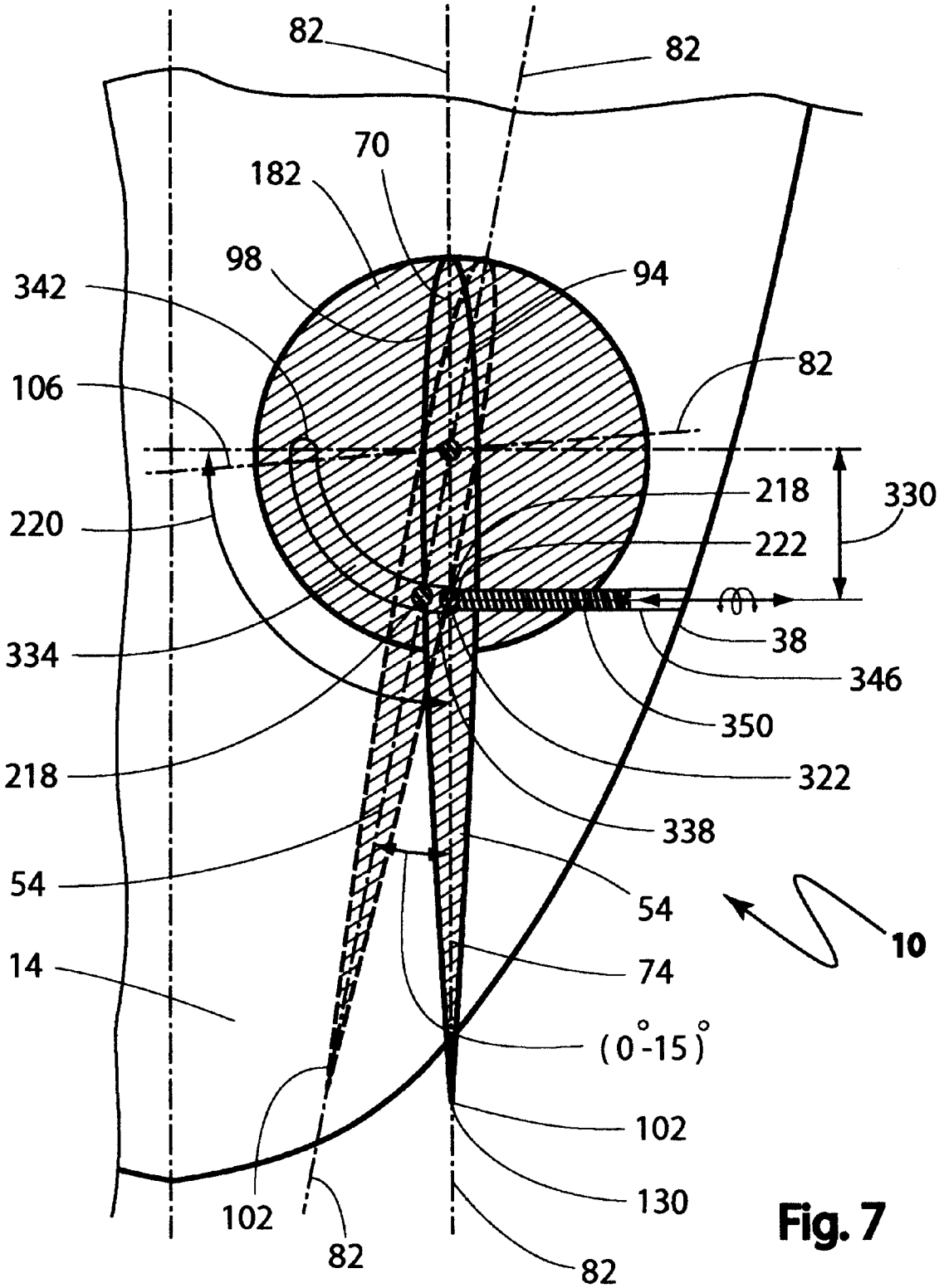
FIG. 7 is a plan view detail illustrating a means for controlling rotation of the first side fin.

As illustrated in FIG. 4, the first side fin 54 is located adjacent the first side 38 of the watercraft 14 and the second side fin 58 is located adjacent the second side 42. Each of the first 54 and second 58 side fins has a top end 62, a bottom end 66, a leading edge 70, a trailing edge 74 and a vertical axis 78. As shown in FIG. 7, a horizontal axis 82 extends from the leading edge 70 to the trailing edge 74 of the fin 54, 58. A front portion 86 of the fin 54, 58 extends from the leading edge 70 to the vertical axis 78. A rear portion 90 of the fin 54, 58 extends from the vertical axis 78 to the trailing edge 74. The fin 54, 58 includes and first 94 and second 98 lateral surfaces. Each of the first 54 and second 58 side fins is rotatably mounted about the vertical axis 78 to the lower surface 30 of the watercraft 14. As illustrated in FIG. 3, the first side fin 54 is rotatable from a first position 102 to a second position 106. The second side fin 58 is rotatable from a third position 110 to a fourth position 114.

When the watercraft 14 is forced to move in a direction 112 parallel to its centerline 46, an oncoming flow of water 118 beneath the watercraft 14 will cause the first side fin 54 and the second side fin 58 to rotate to the first 102 and third 110 positions, respectively. As illustrated in FIG. 6*a*, when the watercraft 14 is forced to move in a direction 122 from the centerline 46 toward its first side 38, the oncoming water flow 118 will cause the first side fin 54 to rotate to the second position 106 and the second side fin 58 to remain in the third position 110. As illustrated in FIG. 6*b*, when the watercraft 14 is forced to move in a direction 126 from the centerline 46 toward its second side 42 the oncoming water flow 118 will cause the second side fin 58 to rotate to the fourth position 114 and the first side fin 54 to remain in the first position 102.

In a variant of the invention, illustrated in FIG. 3, when the first side fin 54 is located in the first position 102 its horizontal axis 82 is parallel to the centerline 46 of the watercraft 14. When the second side fin 58 is located in the third position 110 its horizontal axis 82 is parallel to the centerline 46 of the watercraft 14. When the first side fin 54 is located in the second position 106 its horizontal axis 82 is angled toward the centerline 46 at between zero and ninety degrees to a position 130 of the horizontal axis 82 when the first side fin 54 is located in the first position 102. When the second side fin 58 is located in the fourth position 114 its horizontal axis 82 is angled toward the centerline 46 at between zero and ninety degrees to a position 134 of the horizontal axis 82 when the second side fin 58 is located in the third position 110.

Figure 8:
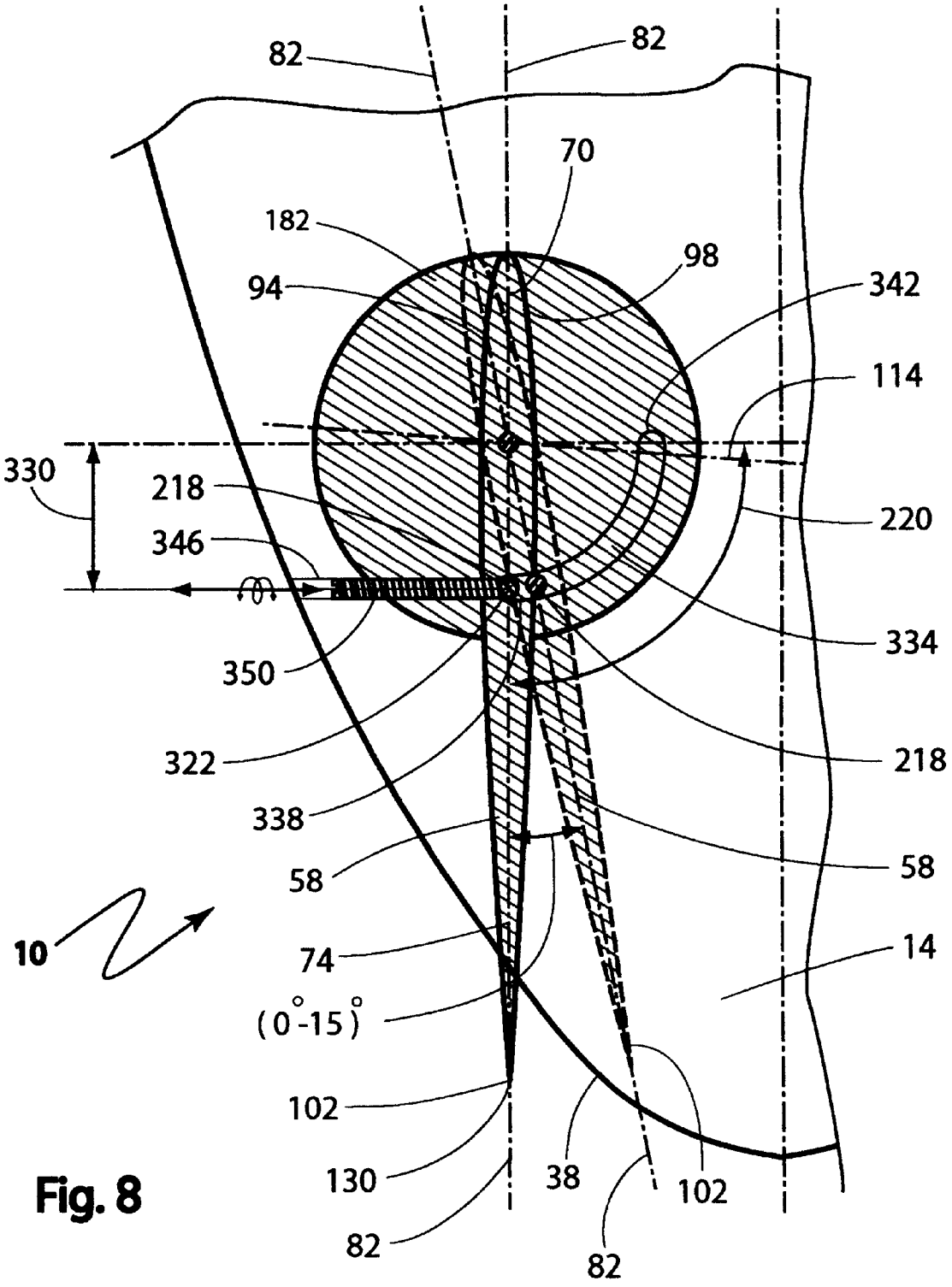
FIG. 8 is a plan view detail illustrating a means for controlling rotation of the second side fin.

In a further variant, as illustrated in FIGS. 7 and 8, when the first side fin 54 is located in the first position 102 its horizontal axis 82 is angled toward the centerline 46 of the watercraft 14 at a fixed angle between zero and fifteen degrees. When the second side fin 58 is located in the third position 110 its horizontal axis 82 is angled toward the centerline 46 of the watercraft 14 at a fixed angle between zero and fifteen degrees. When the first side fin 54 is located in the second position 106 its horizontal axis 82 is angled toward the centerline 46 at between zero and ninety degrees to a position 130 of the horizontal axis 82 when the first side fin 54 is located in the first position 102. When the second side fin 58 is located in the fourth position 114 its horizontal axis 82 is angled toward the centerline 46 at between zero and ninety degrees to a position 134 of the horizontal axis 82 when the second side fin 58 is located in the third position 110.

Figure 4A:
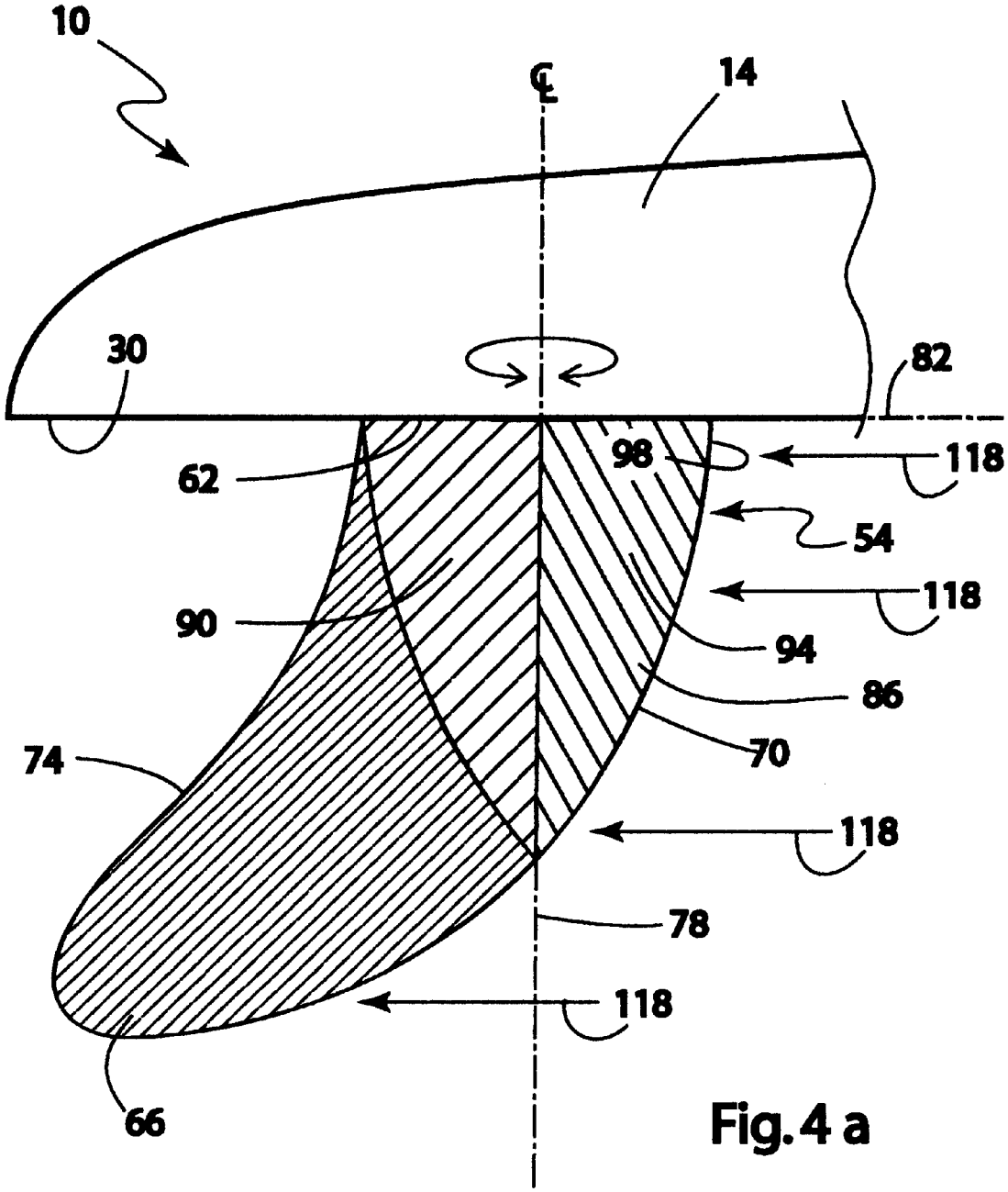
FIG. 4*a* is a detailed side elevational view of a first side fin.
Figure 4B:
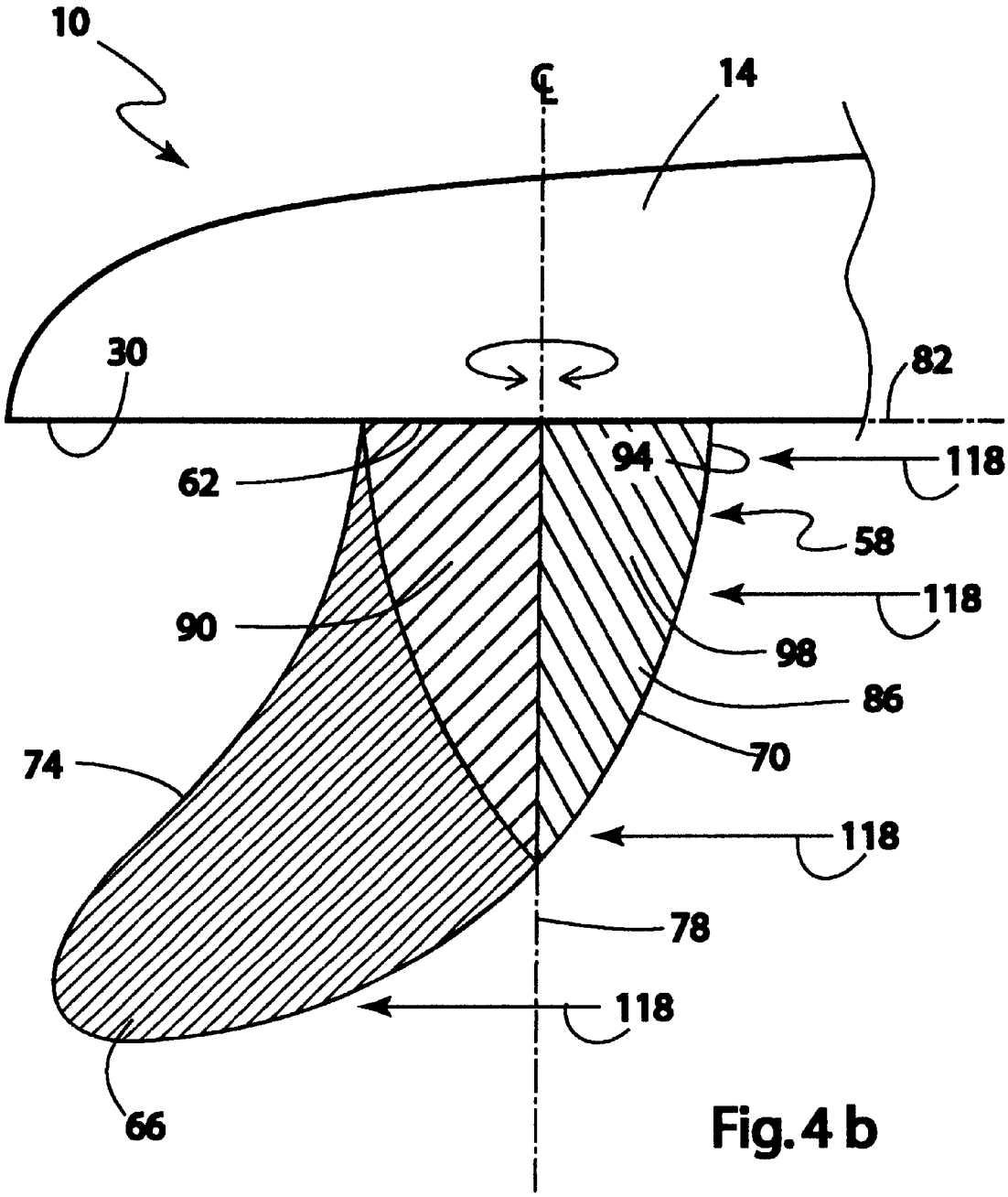
FIG. 4*b* is a detailed side elevational view of a second side fin.

In yet another variant of the invention, as shown in FIGS. 4*a* and 4*b*, the rear portion 90 of each of the first 54 and second 58 side fins is larger than the front portion 86 of the fins 54, 58, causing the fins 54, 58 to rotate so as to align with a flow 118 of oncoming water.

In still another variant, illustrated in FIGS. 7 and 8, the first lateral surface 94 of each of the first 54 and second 58 side fins is symmetrical to the second lateral surface 98 of each of the first 54 and second 58 side fins.

Figure 5:
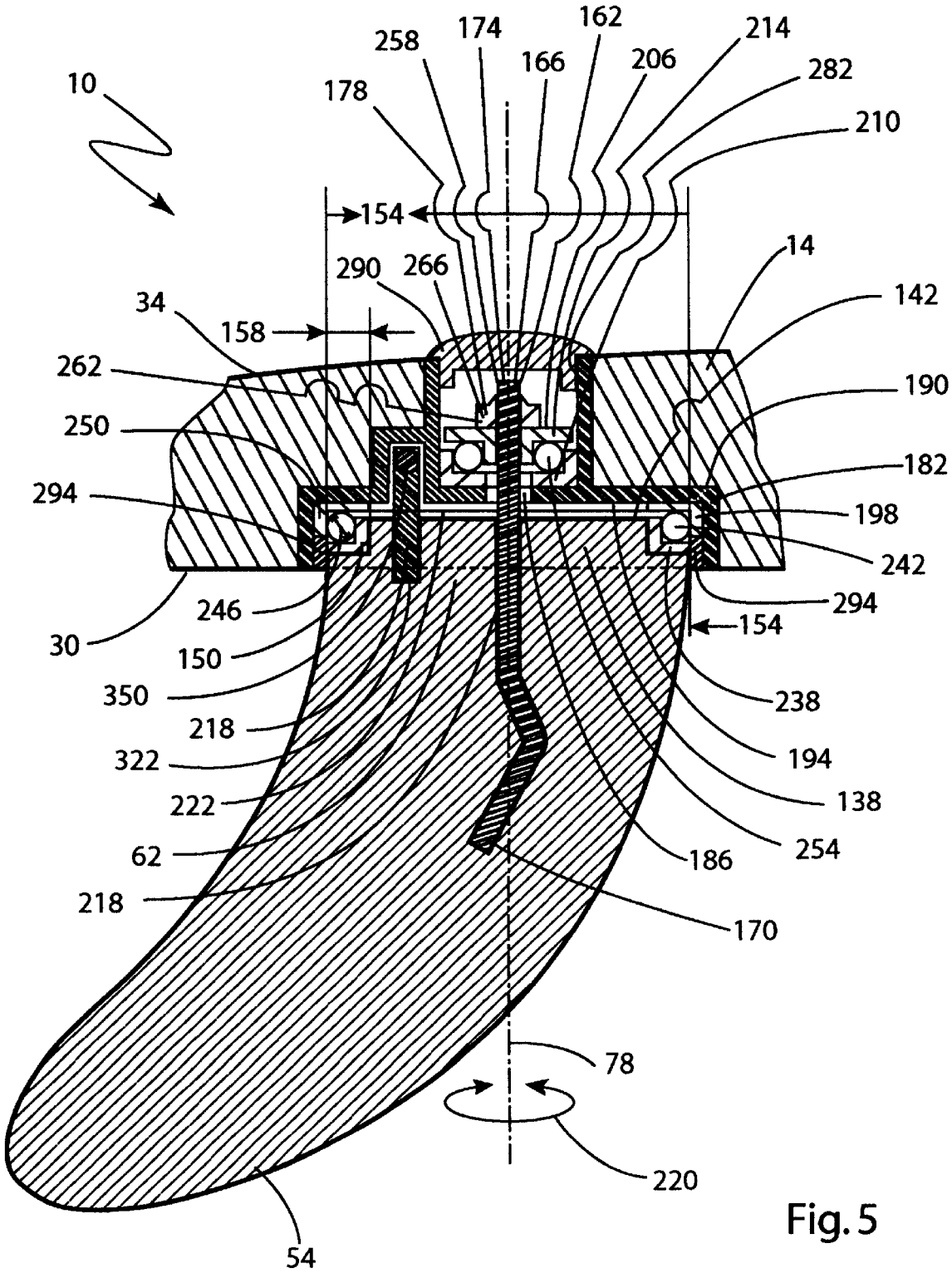
FIG. 5 is a cross-sectional view of a fin of the FIG. 1 embodiment taken along the line 5—5.
Figure 9:
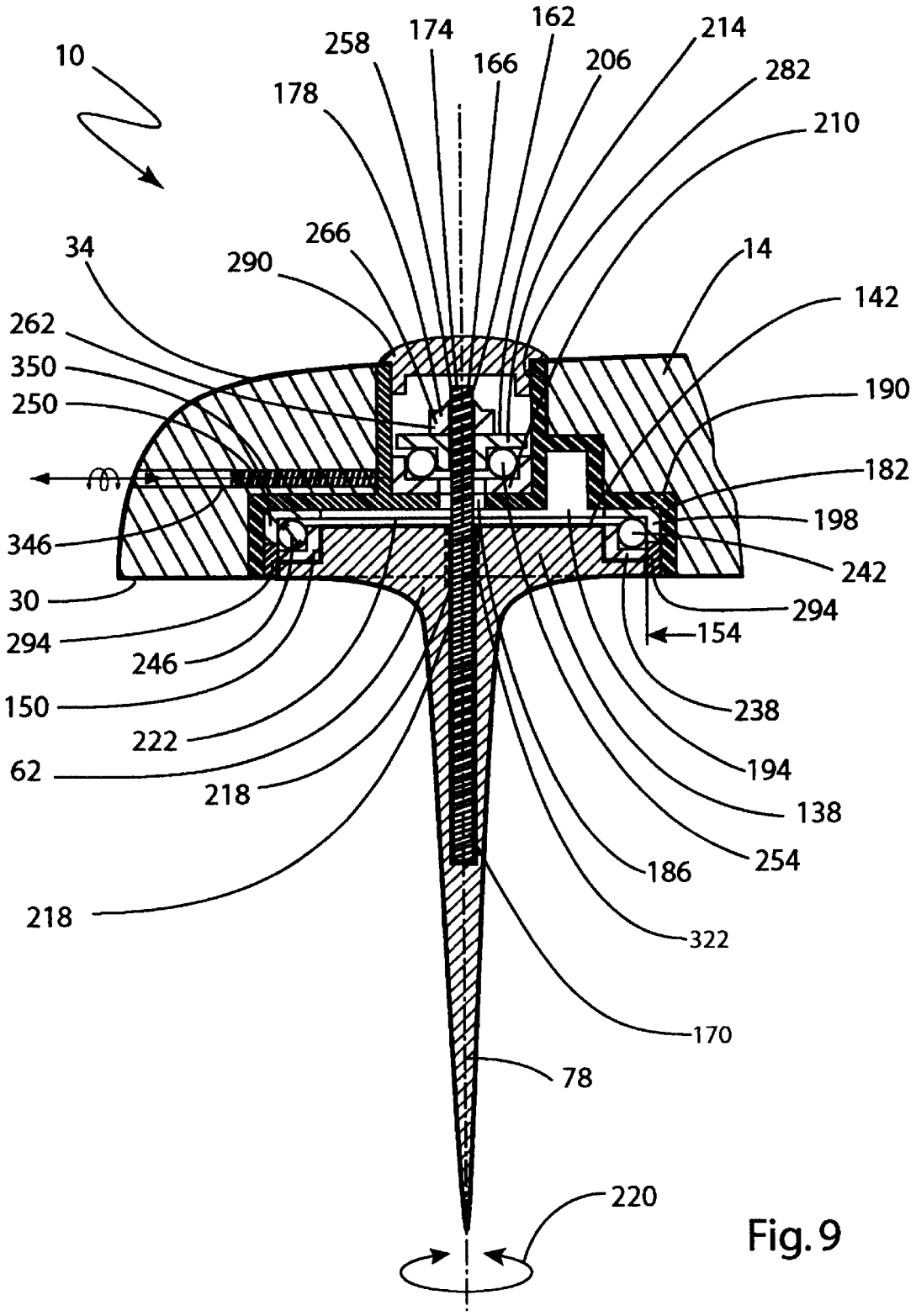
FIG. 9 is a cross-sectional detail of the FIG. 8 means taken along the line 8—8.

In still a further variant, illustrated in FIGS. 5 and 9, a circular rotational portion 138 is located at the top end 62 of each of the fins 54, 58. The rotational portion 138 has a top surface 142 and a bottom surface 146. The top surface 142 is at right angles to the vertical axis 78 and has a first circular bearing track 150 adjacent a perimeter 154 of the top surface 142. The first circular bearing track 150 has a first diameter 154 and a first width 158. An axle 162 is provided. The axle 162 has a first end 166 and a second end 170 and is fixedly attached to the fin 54, 58 at the second end 170 and extends upwardly through the vertical axis 78. The axle 162 has an attaching means 174 located at the first end 166. A securing means 178 is provided. The securing means 178 is sized and shaped to engage the attaching means 174 at the first end 166 of the axle 162.

A circular bearing plate 182 is provided. The bearing plate 182 has a central orifice 186 and is sized to slidably accommodate the axle 162. The bearing plate 182 has an upper surface 190 and a lower surface 194. The lower surface 194 has a second circular bearing track 198 of the first diameter 154 and of the first width 158 adjacent to a perimeter 202 of the bearing plate 182. The second bearing track 198 is sized and shaped to fit slidably against the first bearing track 150.

A bearing 206 is provided. The bearing 206 has an outer shell 210 and an inner sleeve 214. The sleeve 214 is slidably rotatable within the outer shell 210, the outer shell 210 is fixedly mounted to the upper surface 190 of the bearing plate 182 above the central orifice 186. The inner sleeve 214 is attached to the axle 162 such that the axle 162 cannot rotate with respect to the sleeve 214. Means 218 are provided for limiting rotation 220 of the fin 54, 58 with respect to the bearing plate 182.

A recess 222 is provided. The recess 222 extends upwardly from the lower surface 30 of the watercraft 14 and is sized and shaped to accommodate the first end 166 of the axle 162, the attaching means 174, the circular bearing plate 182, the bearing 206 and the top surface 142 of the circular rotational portion 138 of the fin 54, 58. Means 226 are provided for attaching the bearing plate 182 within the recess 222 such that the bearing plate 182 does not rotate with respect to the watercraft 14 and the top surface 142 of the circular rotational portion 138 of the fin 54, 58 is maintained at a level 230 of the lower surface 30 of the watercraft 14.

When the first end 166 of the axle 162 is extended through the orifice 186 in the bearing plate 182 and secured to the inner sleeve 214 of the bearing 206, the first bearing track 150 is fitted slidably against the second bearing track 198, the securing means 178 engaging the attaching means 174 at the first end 166 of the axle 162 and the bearing plate 182 is secured to the recess 222, the fin 54, 58 will be rotatably attached to the lower surface 30 of the watercraft 14.

In another variant of the invention, also illustrated in FIG. 9, the first 94 and second 98 lateral surfaces join the bottom surface 146 of the circular rotational portion 138 of each of the first 54 and second 58 side fins in a radius 234, thereby increasing the resistance of each of the fins 54, 58 to lateral forces.

In still another variant, illustrated in FIG. 5, a first ball bearing race 238 is provided. The first ball bearing race 238 extends upwardly from the first circular bearing track 150 and is sized and shaped to fit slidably a series of ball bearings 242 of a second diameter 246. A mating second ball bearing race 250 is provided. The second ball bearing race 250 extends downwardly from the second circular bearing track 198 and is sized and shaped to fit slidably a series of ball bearings 242 of the second diameter 246. A series of ball bearings 242 of the second diameter 246 is provided. The series of ball bearings 242 is located between the first 238 and second 250 circular bearing races.

In still a further variant the bearing 206 is either a ball bearing 254 or a roller bearing (not shown).

In yet a further variant of the invention, illustrated in FIG. 5, the attaching means 174 is a male thread 258 located at the first end 166 of the axle 162 and the securing means 178 is a washer 262 and a mating threaded locking nut 266.

Figure 5A:
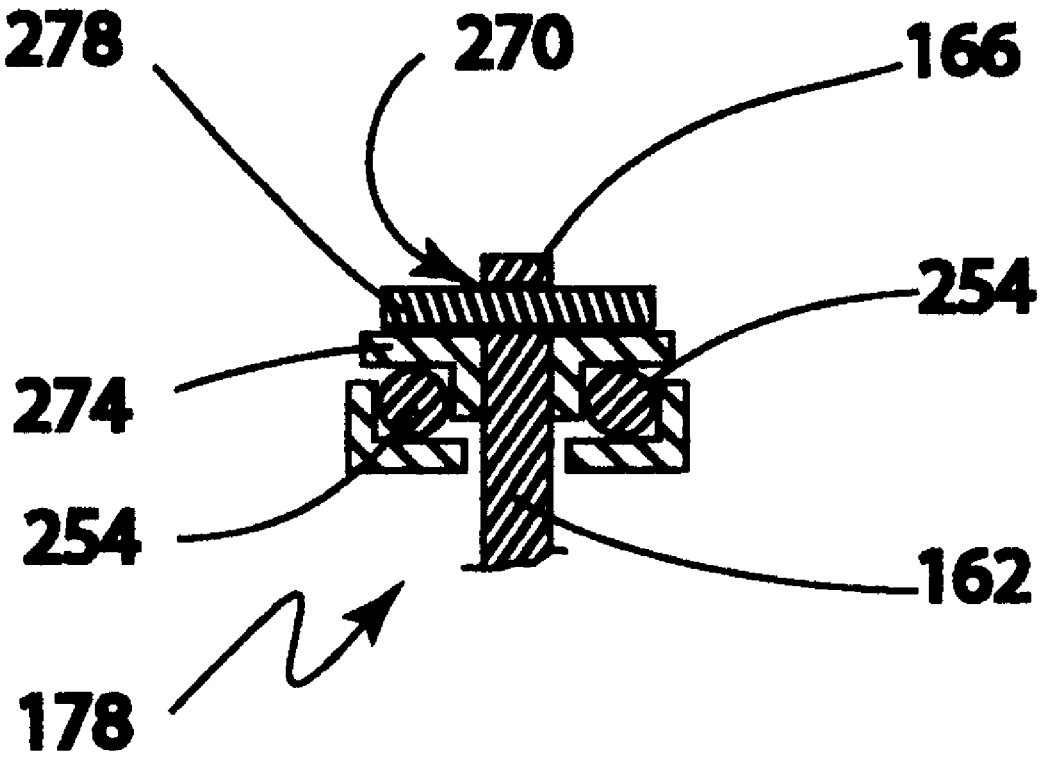
FIG. 5*a* is a side elevational detail of an alternate securing means and attaching means for securing the fin to the watercraft.

In another variant, illustrated in FIG. 5*a*, the attaching means 174 is a transverse hole 270 in the first end 166 of the axle 162 and the securing means 178 is a washer 274 and pin 278. The pin 278 is sized and shaped to fit frictionally within the transverse hole 270.

Figure 12:
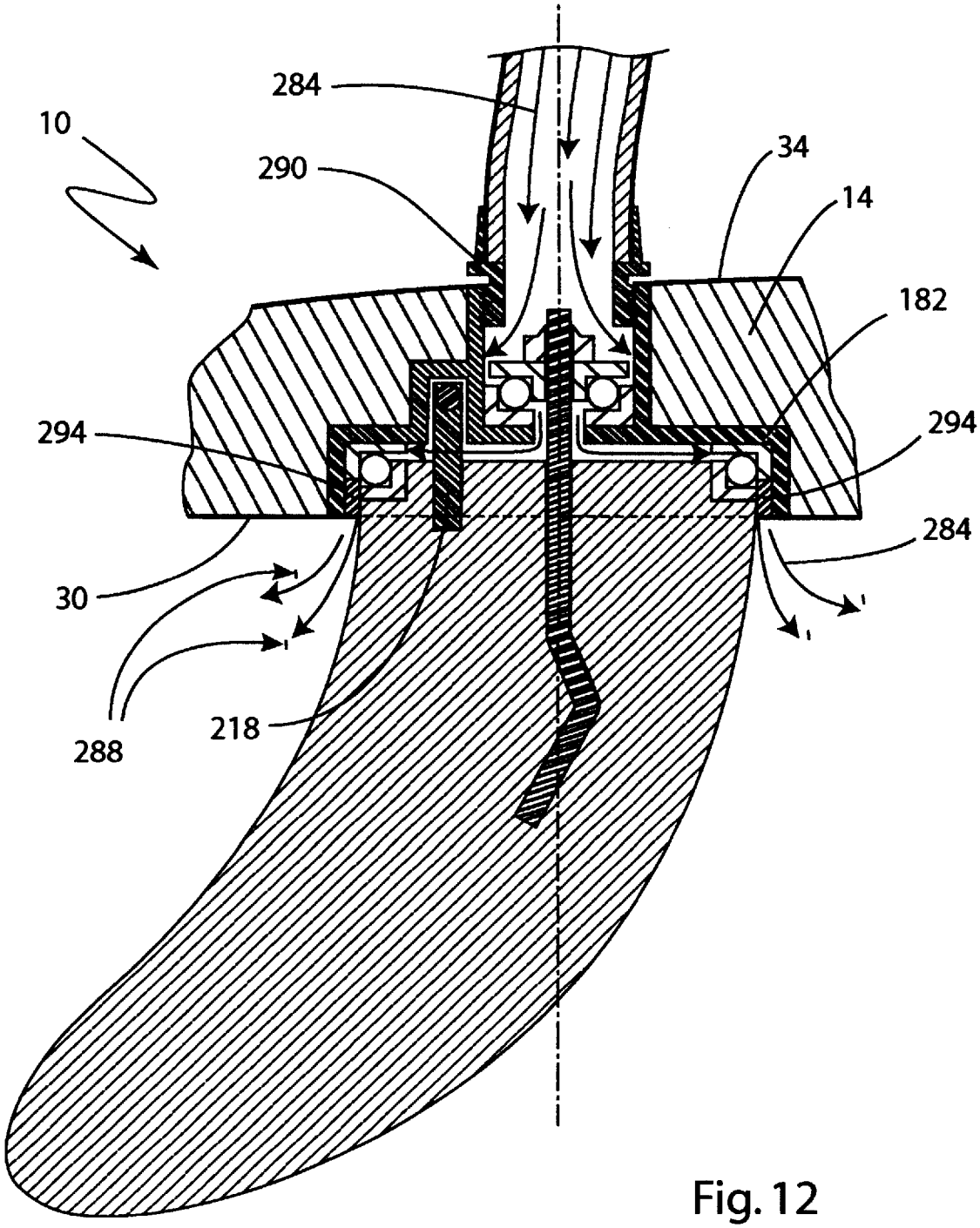
FIG. 12 is a cross-sectional view of the fin illustrating a water stream removing particles of sand and debris from the region of the circular bearing plate.

In yet another variant, illustrated in FIGS. 5 and 9, the watercraft 14 includes an opening 282. The opening 282 extends from the upper surface 34 of the watercraft 14 into the recess 222. The opening 282 provides access to the attaching means 174 and the securing means 178. As illustrated in FIG. 12, the opening 282 provides for means 290 for introducing a stream of water 284 into the recess 222 to facilitate the removal of dirt and debris 288 from the bearing 206 and from the first 150 and second 198 circular bearing tracks.

In still another variant, also illustrated in FIGS. 5 and 9, the fin and watercraft system 10 includes a removable sealing plug 290. The plug 290 is sized and shaped to fit frictionally within the opening 282. In a further variant, the system includes a flexible seal.

Figure 10:
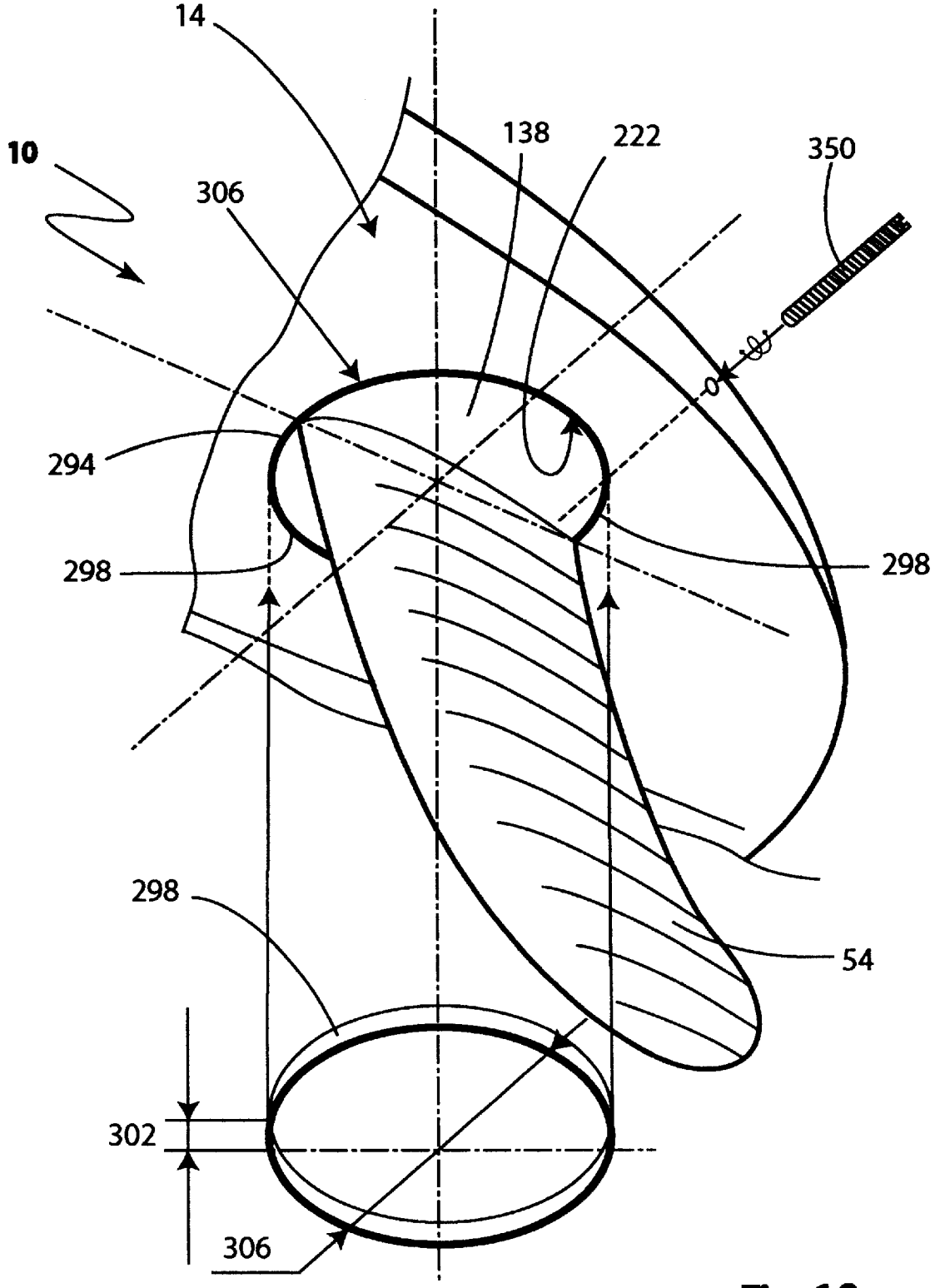
FIG. 10 is a detailed perspective view of the lower surface of the watercraft illustrating the flexible seal.

In a further variant, illustrated in FIG. 10, the system 10 includes a flexible seal 294. The flexible seal 294 includes a ring 298. The ring 298 is formed of resilient material and is fixedly attached to the recess 222 of the watercraft 14. The ring 298 extends from the lower surface 30 of the watercraft 14 upwardly for a first predetermined distance 302. The ring 298 is sized and shaped to fit slidably about an outer diameter 306 of the circular rotational portion 138 of the fin 54, 58. When the ring 298 bears against the outer diameter 306 of the circular rotational portion 138 of the fin 54, 58, a flexible seal 294 will be formed that permits rotation of the fin 54, 58 with respect to the watercraft 14 while controlling the entry of sand and debris into a region of the bearing plate 182.

In still a further variant of the invention, illustrated in FIGS. 7 and 9, the means 218 for limiting rotation 220 of the fin 54, 58 with respect to the bearing plate 182 includes a pin 322. The pin 322 extends vertically from the top surface 142 of the circular rotational portion 138 of the fin 54, 58 for a first predetermined distance 326. The pin 322 is spaced from the vertical axis 78 of the fin 54, 58 by a second predetermined distance 330. An arcurate slot 334 is provided. The slot 334 has a first end 338 and a second end 342 and penetrates the bearing plate 182 from its upper surface 190 to its lower surface 194. The arcurate slot 334 is sized and shaped to slidably fit the pin 322. The first end 338 of the slot 334 is positioned such that the fin 54, 58 is in either the first position 102 or the third position 110 when the pin 322 is positioned at the first end 338 of the slot 334. The second end 342 of the slot 334 is positioned such that the fin 54, 58 is in either the second position 106 or the fourth position 114 when the pin 322 is positioned near the second end 342 of the slot 334.

In still another variant, also illustrated in FIGS. 7 and 9, the fin and watercraft system 10 includes a threaded opening 346. The opening 346 extends from the first 38 or second 42 side of the watercraft 14 to the nearest recess 222 adjacent the pin 322. An elongated setscrew 350 is provided. The setscrew 350 is sized and shaped to engage the threaded opening 346 and is of sufficient length to bear against the pin 322 when the fin 54, 58 is in either of the first 102 or third 110 position. When the setscrew 350 is turned inwardly to bear against the pin 322, the horizontal axis 82 of the fin 54, 58 will be deflected from being parallel to the centerline 46 of the watercraft 14 by an angle of between zero and fifteen degrees.

Figure 11A:
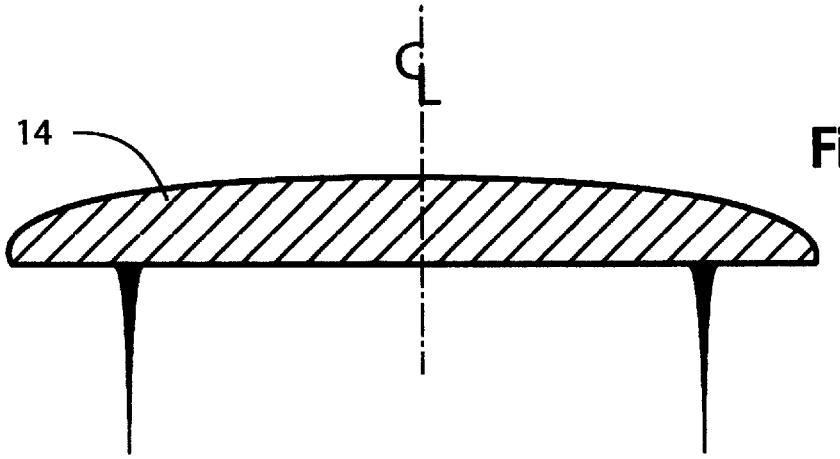
FIG. 11*a* is a cross-sectional view of a watercraft illustrating a conventional hull configuration.
Figure 11B:
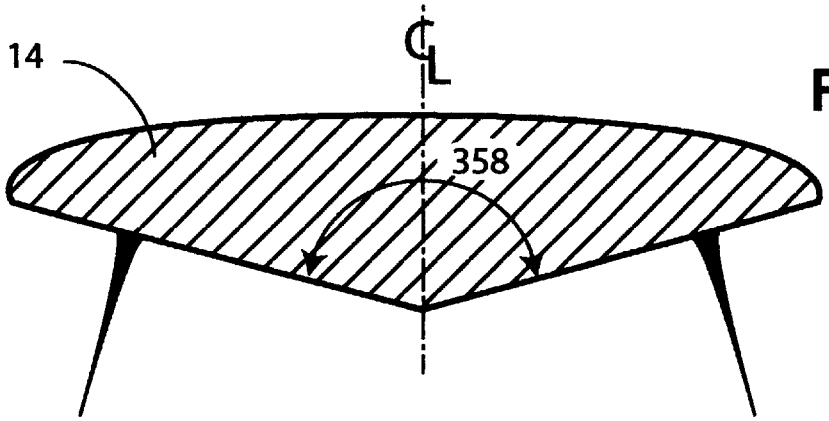
FIG. 11*b* is a cross-sectional view of a second embodiment of a watercraft illustrating a V-shaped hull configuration.
Figure 11C:
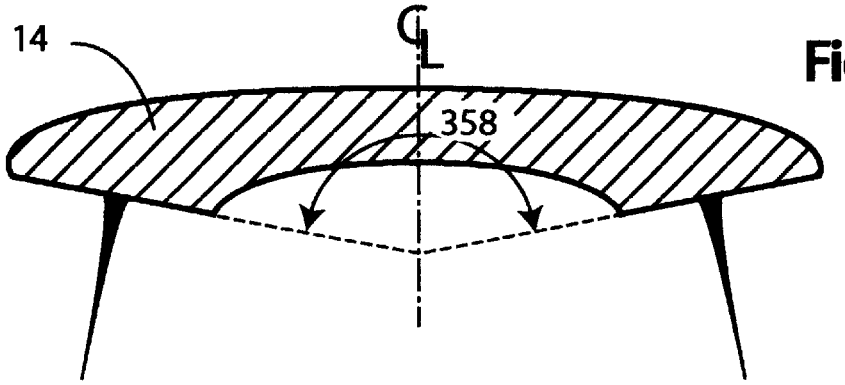
FIG. 11*c* is a cross-sectional view of a third embodiment of a watercraft illustrating a V-shaped hull configuration.
Figure 11D:
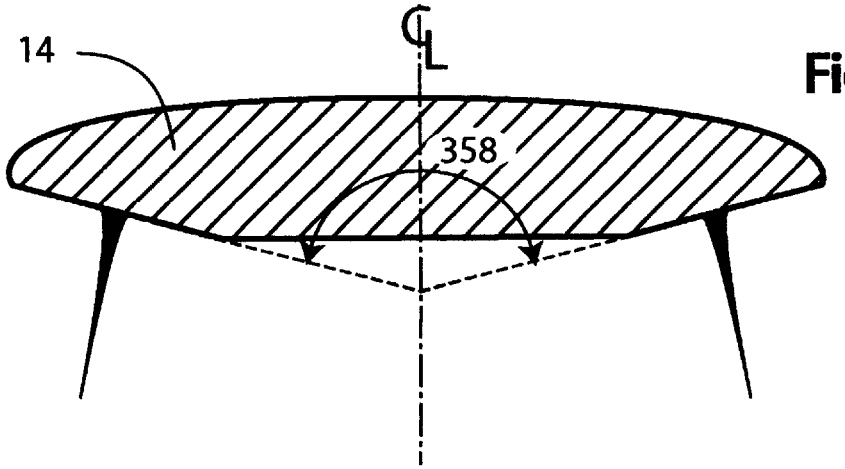
FIG. 11*d* is a cross-sectional view of a third embodiment of a watercraft illustrating a V-shaped hull configuration.

In still a further variant, as shown in FIGS. 11*b*–11*d*, the lower surface 30 of the watercraft 14 has a symmetrical V-shaped cross-section 354.

In a final variant of the invention, the included angle 358 of the V-shaped cross-section 354 is between one hundred fifty degrees and one hundred eighty degrees.

The fin and watercraft system 10 has been described with reference to particular embodiments. Other modifications and enhancements can be made without departing from the spirit and scope of the claims that follow.

What is claimed is:

1. A fin and watercraft system, comprising:

a watercraft, said watercraft having a front end, a rear end, a midpoint between said front end and said rear end, a lower surface, an upper surface, first and second sides and a centerline between said first and second sides;

at least one pair of fins, said pair of fins comprising a first side fin and a second side fin, said pair of fins being disposed between the midpoint and the rear end, equidistant from said centerline and equidistant from said rear end;

said first side fin being disposed adjacent said first side and said second side fin being disposed adjacent said second side;

each of said first and second side fins having a top end, a bottom end, a leading edge, a trailing edge, a vertical axis, a horizontal axis extending from said leading edge to said trailing edge, a front portion extending from said leading edge to said vertical axis, a rear portion extending from said vertical axis to said trailing edge, and first and second lateral surfaces;

each of said first and second side fins being rotatably mounted about said vertical axis to the lower surface of the watercraft;

said first side fin being rotatable from a first position to a second position;

said second side fin being rotatable from a third position to a fourth position; and whereby, when the watercraft is forced to move parallel to its centerline, an oncoming flow of water beneath the watercraft will cause the first side fin and the second side fin to rotate to the first and third positions, respectively, and when the watercraft is forced to move in a direction from the centerline toward its first side the oncoming water flow will cause the first side fin to rotate to the second position and the second side fin to remain in the third position, and when the watercraft is forced to move in a direction from the centerline toward its second side the oncoming water flow will cause the second side fin to rotate to the fourth position and the first side fin to remain in the first position.

2. A fin and watercraft system, as described in claim 1, wherein:

when said first side fin is disposed in said first position its horizontal axis is parallel to the centerline of the watercraft;

when said second side fin is disposed in said third position its horizontal axis is parallel to the centerline of the watercraft;

when said first side fin is disposed in said second position its horizontal axis is angled toward said centerline at between zero and ninety degrees to a position of said horizontal axis when said first side fin is disposed in said first position; and when said second side fin is disposed in said fourth position its horizontal axis is angled toward said centerline at between zero and ninety degrees to a position of said horizontal axis when said second side fin is disposed in said third position.

3. A fin and watercraft system, as described in claim 1, wherein:

when said first side fin is disposed in said first position its horizontal axis is angled toward the centerline of the watercraft at a fixed angle between zero and fifteen degrees;

when said second side fin is disposed in said third position its horizontal axis is angled toward the centerline of the watercraft at a fixed angle between zero and fifteen degrees;

when said first side fin is disposed in said second position its horizontal axis is angled toward said centerline at between zero and ninety degrees to said horizontal axis when disposed in said first position; and when said second side fin is disposed in said fourth position its horizontal axis is angled toward said centerline at between zero and ninety degrees to said horizontal axis when disposed in said first position.

4. A fin and watercraft system, as described in claim 1, wherein the rear portion of each of the first and second side fins is larger than the front portion of said fins, causing said fins to rotate so as to align with a flow of oncoming water.

5. A fin and watercraft system, as described in claim 1, wherein the first lateral surface of each of the first and second side fins is symmetrical to the second lateral surface of each of the first and second side fins.

6. A fin and watercraft system, as described in claim 1, further comprising:

a circular rotational portion disposed at the top end of each of the fins, said rotational portion having an top surface and a bottom surface, said top surface being orthogonal to the vertical axis and having a first circular bearing track adjacent a perimeter of said top surface, said first circular bearing track having a first diameter and a first width;

an axle, said axle having a first end and a second end and being fixedly attached to the fin at said second end and extending upwardly through the vertical axis;

said axle having an attaching means disposed at said first end;

a securing means, said securing means being sized and shaped to engage the attaching means at said first end;

a circular bearing plate, said bearing plate having a central orifice, said orifice being sized to slidably accommodate said axle, an upper surface, and a lower surface, said lower surface having a second circular bearing track of the first diameter and of the first width, adjacent a perimeter of said bearing plate;

said second bearing track being sized and shaped to fit slidably against said first bearing track;

a bearing, said bearing having an outer shell and an inner sleeve, said sleeve being slidably rotatable within said outer shell, said outer shell being fixedly mounted to the upper surface of the bearing plate above said central orifice, said inner sleeve being attached to said axle such that the axle can not rotate with respect to said sleeve;

means for limiting rotation of the fin with respect to the bearing plate;

a recess, said recess extending upwardly from the lower surface of the watercraft and being sized and shaped to accommodate the first end of the axle, the attaching means, the circular bearing plate, the bearing and the top surface of the circular rotational portion of the fin;

means for attaching said bearing plate within said recess such that the bearing plate does not rotate with respect to the watercraft and the top surface of the circular rotational portion of the fin is maintained at a level of the lower surface of the watercraft; and whereby, when the first end of the axle is extended through the orifice in the bearing plate and secured to the inner sleeve of the bearing, the first bearing track being fitted slidably against the second bearing track, the securing means engaging the attaching means at the first end of the axle and the bearing plate is secured to the recess, the fin will be rotatably attached to the lower surface of the watercraft.

7. A fin and watercraft system, as described in claim 6 wherein the first and second lateral surfaces join the bottom surface of the circular rotational portion of each of the first and second side fins in a radius, thereby increasing the resistance of each of the fins to lateral forces.

8. A fin and watercraft system, as described in claim 6, further comprising:

a first ball bearing race, said first ball bearing race extending upwardly from said first circular bearing track and being sized and shaped to fit slidably a series of ball bearings of a second diameter;

a mating second ball bearing race, said second ball bearing race extending downwardly from said second circular bearing track and being sized and shaped to fit slidably a series of ball bearings of the second diameter; and a series of ball bearings of the second diameter, said series of ball bearings being disposed between the first and second circular bearing races.

9. A fin and watercraft system, as described in claim 6, wherein the bearing is either of a ball bearing and a roller bearing.

10. A fin and watercraft system, as described in claim 6, wherein the attaching means is a male thread disposed at the first end of the axle and the securing means comprises a washer and a mating threaded locking nut.

11. A fin and watercraft system, as described in claim 6, wherein the attaching means is a transverse hole in the first end of the axle and the securing means comprises a washer and pin, said pin being sized and shaped to fit frictionally within said transverse hole.

12. A fin and watercraft system, as described in claim 6, wherein the watercraft includes an opening, said opening extending from the upper surface of the watercraft into the recess, said opening providing access to said attaching means and said securing means and providing means for introducing a stream of water into the recess to facilitate the removal of dirt and debris from the bearing and from the first and second circular bearing tracks.

13. A fin and watercraft system, as described in claim 12 further comprising a removable sealing plug, said plug being sized and shaped to fit frictionally within said opening.

14. A fin and watercraft system, as described in claim 6, further comprising:

a flexible seal, said seal comprising:

a ring, said ring being formed of resilient material, being fixedly attached to the recess of the watercraft and extending from the lower surface of the watercraft upwardly for a first predetermined distance;

said ring being sized and shaped to fit slidably about an outer diameter of the circular rotational portion of the fin; and whereby, when the ring bears against the outer diameter of the circular rotational portion of the fin, a flexible seal will be formed that permits rotation of the fin with respect to the watercraft while controlling the entry of sand and debris into a region of the bearing plate.

15. A fin and watercraft system, as described in claim 6, wherein the means for limiting rotation of the fin with respect to the bearing plate further comprises:

a pin, said pin extending vertically from the top surface of the circular rotational portion of the fin for a first predetermined distance;

said pin being spaced from the vertical axis of the fin by a second predetermined distance;

an arcurate slot, said slot having a first end and a second end, penetrating the bearing plate from its upper surface to its lower surface and being sized and shaped to slidably fit said pin;

said first end of said slot being positioned such that the fin is in either of the first position and the third position when said pin is positioned at said first end; and said second end of said slot being positioned such that the fin is in either of the second position and the fourth position when said pin is positioned at said second end.

16. A fin and watercraft system, as described in claim 15, further comprising:

a threaded opening, said opening extending from either of the first or second side of the watercraft to the nearest recess adjacent said pin;

an elongated setscrew, said setscrew being sized and shaped to engage said threaded opening and of sufficient length to bear against said pin when the fin is in either of the first or third position; and whereby, when the setscrew is turned inwardly to bear against the pin, the horizontal axis of the fin will be deflected from being parallel to the centerline of the watercraft by an angle between zero and fifteen degrees.

17. A fin and watercraft system, as described in claim 1 wherein the lower surface of the watercraft has a symmetrical V-shaped cross-section.

18. A fin and watercraft system, as described in claim 17 wherein the included angle of said V-shaped cross-section is between one hundred fifty degrees and one hundred eighty degrees.

* * * * *